US011646476B1

(12) United States Patent
Wrigley

(10) Patent No.: US 11,646,476 B1
(45) Date of Patent: May 9, 2023

(54) COMPACT ORTHOMODE TRANSDUCER ASSEMBLY

(71) Applicant: Lockheed Martin Corporation, Bethesda, MD (US)

(72) Inventor: Jason Stewart Wrigley, Littleton, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 156 days.

(21) Appl. No.: 17/342,741

(22) Filed: Jun. 9, 2021

(51) Int. Cl.
*H01P 1/161* (2006.01)
*H01P 11/00* (2006.01)
*H01P 1/04* (2006.01)

(52) U.S. Cl.
CPC ..... *H01P 1/161* (2013.01); *H01P 1/04* (2013.01); *H01P 11/001* (2013.01)

(58) Field of Classification Search
CPC ..... H01P 1/161; H01P 1/04; H01P 11/011
See application file for complete search history.

(56) References Cited

U.S. PATENT DOCUMENTS 3,758,882 A * 9/1973 Morz ..... H01P 1/161 333/248

FOREIGN PATENT DOCUMENTS

CA 2379151 A1 * 11/2001

OTHER PUBLICATIONS

Smith, Louis, Masters' Thesis, "Design and Feasibility Study of an Orthomode Transducer For The FAST Experiment," 110 pages, Sep. 2012.

Dunning, A. et al., "A Simple Orthomode Transducer For Centimeter To Submillimeter Wavelengths," 20th International Symposium on Space Terahertz Technology, pp. 191-194, Apr. 20-22, 2009.

Kamili, Abdellah El et al., "A Dual Bank Orthomode Transducer In K/Ka Bands For Satellite Communications Applications," Progress In Electromagnetics Research Letters, vol. 73, pp. 77-82, 2018.

Narayanan, Gopal et al., Abstract for "Design and Performance of A Novel Full-Waveguide Band Orthomode Transducer," https://lweb.cfa.harvard.edu/srlab/13thterahertzsymposium/abstracts/Narayanan.pdf, 1 page, downloaded Jun. 8, 2021.

* cited by examiner

*Primary Examiner* — Hafizur Rahman
*Assistant Examiner* — Kimberly E Glenn

(57) ABSTRACT

An asymmetric, broadband, compact and low-PIM orthomode transducer comprised of two parts is presented. Mating of the two parts results in the formation of a choke flange as well as a critical impedance step which suppresses unwanted modes and enables broadband matching of the junction between the two parts. Furthermore, a cruciform-quatrefoil waveguide type is utilized that transitions to an aperture. This waveguide configuration can lead to a lower overall part length, an improved reflection, and reduced manufacturing costs.

20 Claims, 7 Drawing Sheets

COMPACT ORTHOMODE TRANSDUCER ASSEMBLY

TECHNICAL BACKGROUND

Orthomode transducers (OMTs) are employed in wireless transmission systems to separate or combine vertical and horizontal signal polarizations from a signal or concurrent signals which are transported by a waveguide. Often these components are employed in satellite communication system feed structures which utilize microwave radio frequency (RF) signals, and can be installed in communication uplinks and downlinks to separate transmit (Tx) or receive (Rx) signals or separate concurrent components of circularly polarized signals. However, waveguides and associated OMTs can be difficult to design and manufacture due in part to the high sensitivity of waveguides to manufacturing precision, symmetry, and geometric configurations which can lead to distortions like passive intermodulation (PIM). PIM results in undesirable distortion, non-linearity, or mixing among signals within waveguides from physical properties of the waveguide, such as mechanical interfaces, surface defects, materials, or improperly designed geometric features. Various techniques and structures have been developed to address PIM and other signal distortion concerns for waveguides and OMTs.

For example, recombination networks and various turnstile structures can be employed in OMTs to increase bandwidth capabilities due to improved junction symmetry. Recombination networks include several additional waveguide arms that recombine a portion of the signals and leverage waveform interference effects, but these arms increase the size and part count of OMTs, as well as increase manufacturing complexity since these recombination networks must typically be electroformed or shim tuned (per-article) to achieve necessary tolerances. Other techniques include asymmetric split block OMTs which ease manufacturing by placing manufacturing joints that split along horizontal or vertical port/arm portions of the OMT. However, certain microwave communication bands, such as Ku, contain strong odd-order PIM products which prevent split block manufacturing of OMTs. These odd-order PIM products can significantly disrupt receive channels and require further mitigation by avoidance of mating dissimilar and similar metals. Thus, asymmetric split block OMTs have limited bandwidth than other types of OMTs, or limit operation to non-concurrent transmit and receive of signals.

Overview

Presented herein are various enhanced techniques and assemblies for orthomode transducers (OMTs) and associated waveguide structures. OMTs are employed in antenna feed structures to route microwave signals to/from reflectors, horns, or other directional antenna elements while separating or combining signals according to corresponding signal polarization. The performance of OMTs can be highly sensitive to manufacturing tolerances and design parameters. The example implementations discussed below have a higher level of manufacturability than many other OMTs, using end-milling techniques and minimal usage of specialized techniques such as electrical discharge machining (EDM). High-cost EDM processes such as sinker EDM are avoided entirely. While a two-piece assembly is discussed herein, other manufacturing techniques, such as additive or 3D manufacturing, can produce one-piece assemblies. However, additive techniques might still require a surface smoothing process to ensure surface finish roughness is below a target level. Moreover, the enhanced structures and designs of the OMTs discussed herein provide for greater performance in more compact envelopes than many existing OMT types.

In one example implementation, an orthomode transducer includes a junction element comprising a vertically polarized signal aperture along a longitudinal axis and a horizontally polarized signal aperture along an axis perpendicular to the longitudinal axis. The orthomode transducer also includes a waveguide element having a cruciform cavity coupled to the vertically polarized signal aperture and the horizontally polarized signal aperture and extending along the longitudinal axis to a split plane. The orthomode transducer also includes a choke element formed about at least a portion of the waveguide element and extending to the split plane, and a snout element extending the cruciform cavity from the split plane along the longitudinal axis and comprising a snout cavity that transitions from the cruciform cavity to a cruciform-quatrefoil cavity and from the cruciform-quatrefoil cavity to a circular feed aperture.

Also presented herein is an assembly having two workpieces. A first workpiece includes a junction element comprising a vertically polarized signal aperture along a longitudinal axis and a horizontally polarized signal aperture along an axis perpendicular to the longitudinal axis. The first workpiece also includes a waveguide element having a cruciform cavity coupled to the vertically polarized signal aperture and the horizontally polarized signal aperture and extending along the longitudinal axis to a split plane. The first workpiece also includes a choke element formed about at least a portion of the waveguide element and extending to the split plane. A second workpiece includes a snout element extending the cruciform cavity from the split plane along the longitudinal axis and comprising a snout cavity that transitions from the cruciform cavity to a cruciform-quatrefoil cavity and from the cruciform-quatrefoil cavity to a circular cavity.

In another example implementation, a method includes forming a junction element comprising a vertically polarized signal aperture along a longitudinal axis and a horizontally polarized signal aperture along an axis perpendicular to the longitudinal axis. The method also includes forming a waveguide element having a cruciform cavity coupled to the vertically polarized signal aperture and the horizontally polarized signal aperture and extending along the longitudinal axis to a split plane. The method also includes forming a choke element formed about at least a portion of the waveguide element and extending to the split plane. The method also includes forming a snout element extending the cruciform cavity from the split plane along the longitudinal axis and comprising a snout cavity that transitions from the cruciform cavity to a cruciform-quatrefoil cavity and from the cruciform-quatrefoil cavity to a circular aperture.

This Overview is provided to introduce a selection of concepts in a simplified form that are further described below in the Detailed Description. It may be understood that this Overview is not intended to identify key features or essential features of the claimed subject matter, nor is it intended to be used to limit the scope of the claimed subject matter.

BRIEF DESCRIPTION OF THE DRAWINGS

Many aspects of the disclosure can be better understood with reference to the following drawings. While several implementations are described in connection with these drawings, the disclosure is not limited to the implementations disclosed herein. On the contrary, the intent is to cover all alternatives, modifications, and equivalents.

DETAILED DESCRIPTION

Figure 1:
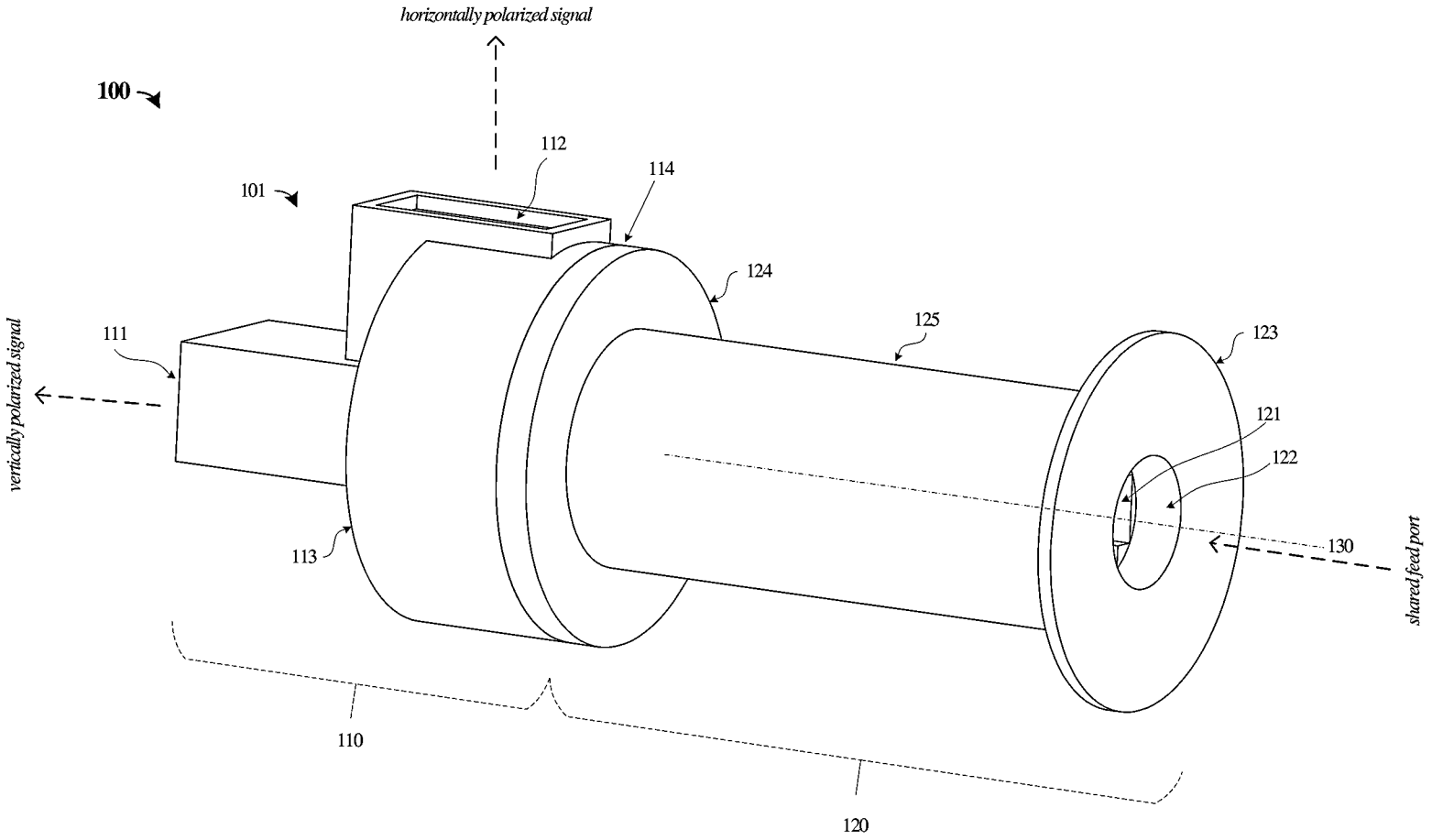
FIG. 1 illustrates an orthomode transducer in an implementation.

Orthomode transducers (OMTs) and associated waveguide structures are discussed herein, sometimes referred to as polarization duplexers. OMTs are employed in antenna feed structures to route microwave radio frequency (RF) signals to/from directional antenna elements while separating or combining signals according to signal polarization. OMTs can be employed to concurrently receive (Rx) and transmit (Tx) signals through the same feed aperture and directional antenna element, where the Rx and Tx signals are polarized in orthogonal orientations, such as vertical and horizontal polarizations. The Tx/Rx signals can often have similar carrier frequencies and still be routed to different source apertures or ports based on the polarization properties. OMTs can also be employed to transmit (or receive) different concurrent signals via the same directional antenna element by combining (or separating) signals having vertical and horizontal polarizations to/from a shared feed aperture. This feed aperture can be coupled to a horn element, and the entire assembly can be positioned nearby a directional antenna element (e.g. parabolic dish).

Associated waveguide portions of OMT assemblies discussed herein comprise cavities or hollow conduit portions which allow for propagation of electromagnetic waves therein. Input/output ports of the OMT assemblies, which couple to transmitter and receiver circuitry, are shown as rectangular in cross-section and correspond to vertically polarized (V) and horizontally polarized (H) signal ports. The portion of the OMT assemblies configured to combine/separate the vertically polarized signals and horizontally polarized signals is referred to herein as a waveguide junction or junction. This junction, as used herein, is different than a mechanical interface or joint between two pieces or parts that comprise the OMT assemblies. Electromagnetic waves travel within cavities formed by the OMT assemblies, and the examples herein have an enhanced set of transitions in cross-section between the V/H ports and a shared feed aperture/port. Tracing a pathway from the V/H ports for illustrative purposes, the OMT assemblies discussed herein transition from the rectangular cross-sections of the input/output ports to a cruciform (cross) cross-section and combine the two orthogonally polarized signals in a shared waveguide cavity. Then, another transition in cross-section occurs to transition from the cruciform cross-section to a cruciform quatrefoil cross-section. Finally, a transition in cross-section occurs from the cruciform quatrefoil cross-section to reach the shared feed aperture of the OMT assemblies, typically a circular cross-section.

The OMT assemblies discussed herein can be comprised of two parts or workpieces which when joined form an interface or joint having a low PIM double choke flange and critical impedance step. This configuration of two parts can be referred to as a split block OMT or OMT assembly. The critical impedance step enables matching of the V/H junction in excess of 25 dB return loss on both V and H polarizations over a broad bandwidth (e.g. Ku band). Various manufacturing techniques are discussed herein to achieve these enhanced designs and structures. For example, the first part can be a fully direct machined part that comprises choke grooves which form the low PIM mating interface at a split plane, a cruciform junction which combines or separates the V and H polarizations, transformers to fit a standard waveguide size for the V polarization arm, transformers to fit a standard waveguide size for the H polarization arm, and an impedance matching pedestal. Example standard waveguide sizes include WR75 having dimensions of 0.75 inches (19.05 mm)×0.375 inches (9.525 mm) and provide for frequency ranges of 10 to 15 GHz. Other standard waveguide sizes can be employed.

A nearly entirely direct machined second part (with one use of wire EDM techniques) comprises the mating surface (split plane) for the choke grooves from the first part, along with cruciform waveguide section which when mated with the first part forms an impedance matching step down to a size which further suppresses higher order modes launched by the junction. A quatrefoil-cruciform waveguide section also included in the second part and can be formed by uniting four cylinders with a cruciform waveguide. This new waveguide type enables direct machining and serves as the first transformer step. The split plane is selected such that it resides in the second part (OMT snout section) rather than in an OMT sidearm.

Various materials can be selected for the elements of the OMT assemblies discussed herein. Typically, suitable materials include conductive materials, such as metals, metallic alloys, or conductive composite materials. Example metals include aluminum, magnesium, copper, iron/ferrous metals, and alloy thereof. Moreover, surface coatings can be applied to enhance conductivity or reduce surface roughness. Typically, dissimilar metals are avoided for joints and interfaces, as dissimilar metals can affect signal quality by producing PIM products, especially the odd 3rd order, which significantly disrupt the receive channel Thus, to mitigate such risk, material selection typically avoids usage of mating of dissimilar metals.

Turning now to FIG. 1, an example OMT assembly is discussed. FIG. 1 includes external isometric view 100 that illustrates OMT assembly 101. Assembly 101 includes first portion 110 and second portion 120 which mate at split plane 114. First portion 110 comprises a junction element which includes two source ports which can couple to transmitter/receiver circuitry. First port 111 comprises a port for vertically polarized signals and is oriented along a longitudinal axis and is oriented along an axis perpendicular to the longitudinal axis, while second port 112 comprises a port for horizontally polarized signals. Ports 111-112 comprise rectangular waveguides which couple into a common or shared internal cavity at a junction. This style of junction comprises an asymmetric junction. The cavity associated with the junction then forms a cruciform waveguide which extends to split plane 114. First portion 110 also includes choke element 113 which includes internal choke cavities (not shown in FIG. 1). Second portion 120 comprises a snout element beginning at split plane 114 with joint element 124 that couples to choke element 113 of first portion 110. Second portion 120 also includes body 125 that houses waveguide 121 formed along longitudinal axis 130 which leads to feed port 122 and couples via feed interface 123 to a feed horn or can directly emit/receive signals from a directional antenna element.

In receive operations, signals can be received at feed aperture 122 for propagation within waveguide 121 to split plane 114. Choke element 113 and joint element 124 produce an impedance step related to a diameter/width change in the waveguide and choke element 113 attenuates various unwanted signals generated by passive intermodulation (PIM) and from other sources of distortion. From here, the received signals can be routed to a source port that corresponds to the polarization of the received signals. In transmission operations, signals received at either of source ports 111-112 can have a particular polarization and are introduced into a shared waveguide or cavity within first portion 110. From here, the choke element 113 attenuates various unwanted signals generated by PIM of the impedance step and from other sources of distortion. Then, waveguide 121 propagates the transmitted signals toward feed aperture 122 for emission towards a directional antenna element. Choke element 113 provides reduced PIM for OMT assembly 101 by at least attenuating (choking) mixed signals generated by PIM, and permits concurrent transmit and receive signals by reducing PIM between transmit and receive frequencies.

First portion 110 might serve as an OMT by itself as it contains the junction between V/H ports to a shared waveguide, however, connection of first portion 110 to a feed horn or other output element might produce undesired performance characteristics. Higher order propagation modes above the dominant mode (i.e. the 3rd, 4th, 5th and 6th modes) would propagate into the feed horn having been launched strongly by the asymmetric junction if first portion 110 was used alone as an OMT. The addition of second portion 120, which steps down to a smaller-size cruciform waveguide, attenuates the higher order modes generated by the asymmetric junction. This configuration enables a broad bandwidth of at least 10.70 to 14.80 gigahertz (GHz) and also allows for inclusion of choke element 113 at split plane 114. Example dimensions for OMT assembly 101 include approximately 4.5 inches in length, suitable for frequencies approximately in the Ku microwave band (which covers frequencies from 12-18 GHz). Other frequency bands or ranges are possible, and the sizing/geometry of OMT assembly 101 can scale to suit these frequency bands.

Figure 2:
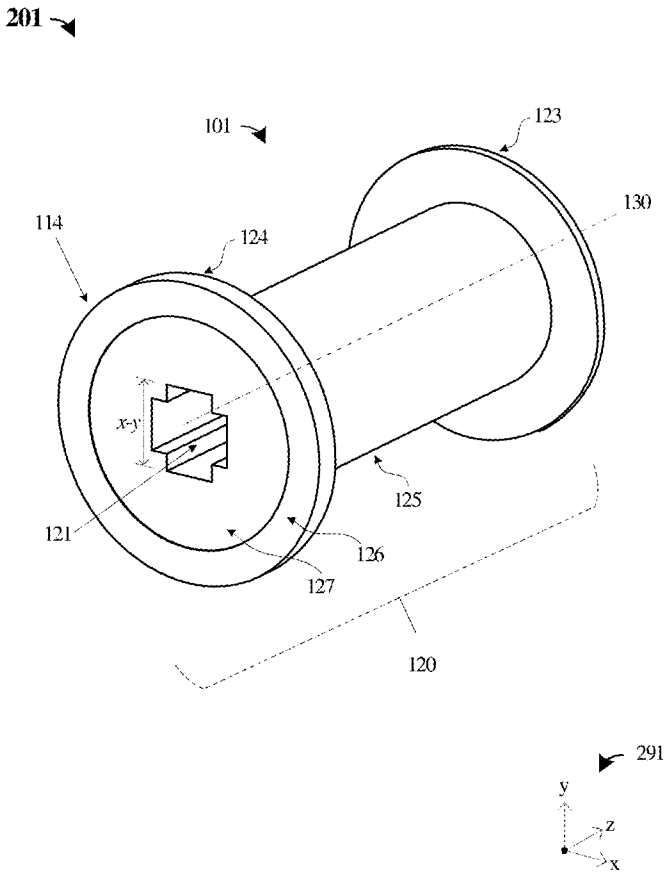
FIG. 2 illustrates components of an orthomode transducer in an implementation.
Figure 2:
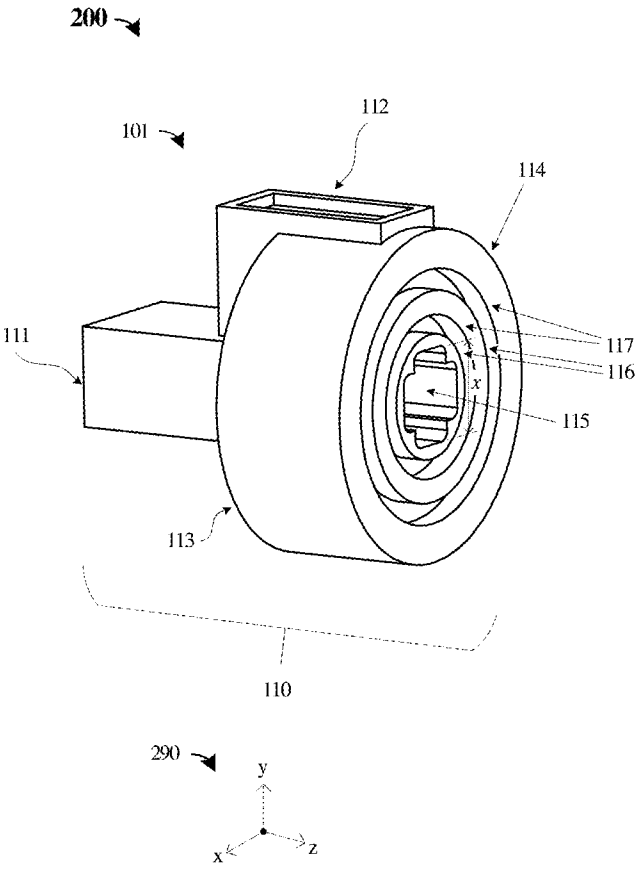

Turning now to further illustrations of OMT assembly 101, FIG. 2 is presented. FIG. 2 shows separate views 200 and 201 illustrating first portion 110, and second portion 120, respectively. Example axes 290 and 291 are shown to compare relative orientations among views 200 and 201. View 200 includes similar elements shown for FIG. 1, and also provides further detail on waveguide 115 and choke element 113 with internal choke cavities 116. View 201 includes similar elements shown in FIG. 1, and also provides further detail on waveguide 121 and joint features 126-127 of joint element 124 at split plane 114.

In view 200, first portion 110, referred to as a junction element, comprises a housing/body and includes waveguide 115 comprising a cavity which extends along longitudinal axis 130 from port 111 to split plane 114. Waveguide 115 forms a cruciform waveguide that extends along longitudinal axis 130 of OMT assembly 101 and can be visualized as superimposed or overlapping rectangular lobes, each with width 'x' as shown. Further internal to first portion 110 is a waveguide junction site (not shown) where V/H signals are combined/separated with respect to the associated ports, and the cruciform cross-section transitions to individual rectangular cross-sections—one for each V/H port. Thus, the cavity that forms waveguide 115 is coupled to cavities that form ports 111-112. Choke element 113 comprises a circular structure formed about at least a portion of waveguide 115 and surrounds walls of waveguide 115. Choke element 113 is formed from one or more concentric ring structures 117 that establish concentric cavities 116 which extend to split plane 114. Choke element 113 also forms an interface with joint element 124 of second portion 120 at split plane 114. Choke element 113 forms a low-PIM double-choke flange and critical impedance step related to a diameter/width change in the waveguide. The critical impedance step enables matching of the V/H junction in excess of 25 dB return loss on both V and H polarizations over a broad bandwidth (e.g. Ku band).

In view 201, second portion 120, referred to as a snout element, comprises body 125 and includes waveguide 121 comprising a snout cavity that extends along longitudinal axis 130 from split plane 114 to feed aperture 122. Waveguide 121 forms a cruciform waveguide, which can be visualized as superimposed or overlapping rectangular lobes, each with width 'x-y' as shown. Width 'x' is similar to that in view 200, thus the size of waveguide 121 is smaller by an amount 'y'. Waveguide 121 continues or extends a cruciform waveguide cross-sectional shape of waveguide 114 along longitudinal axis 130, albeit at a smaller size and on an opposite side of the joint formed at split plane 114 by joint element 124. From here, waveguide 121 transitions to a series of different cavity cross-sections, which are shown in further Figures below. Also shown in view 201 are joint features 126-127 of joint element 124 at split plane 114. Joint feature 127 forms a cavity or gap relative to joint feature 126. Joint feature 126 has a height greater than that of joint feature 127, this height can be approximately 0.010 inches or any suitable gap to prevent electrical contact at split plane 114 through joint feature 127. When joined to first portion 110, joint feature 127 forms a cavity or gap region about waveguide 121 establishing a selected gap between first portion 110 and second portion 120 over at least an inner portion of a radius of split plane 114, while joint feature 126 can couple in a conductive seal with outer ring of choke 113. In this manner, an outer ring of choke 113 and joint feature 126 form flanges which couple to each other to join first portion 110 and second portion 120. The flanges can be referred to as a broadband integrated double choke flange. When first portion 110 and second portion 120 are mated, concentric cavities 116 of choke element 113 are open to waveguide 121 via the selected gapping on a side proximate to second portion 120 and closed by an outer portion of the radius of split plane 114 by joint feature 126 of joint element 124 on the side proximate to second portion 120. Various types of fasteners or clamps can be employed to couple first portion 110 and second portion 120 in accordance with a target interface strength.

The location within OMT assembly 101 for split plane 114 is selected to occur at a low current or zero-current region along the total waveguide length to mitigate PIM effects, as surface currents can act as parasitic frequency mixer. Other OMTs might put a split plane that divides a horizontal polarization port (referred to as a side arm in some cases), which precludes use of a choke as is done in the examples herein. The use of a choke allows for lower PIM, as well as concurrent/simultaneous propagation of Tx/Rx signals through the corresponding waveguide. This is in contrast to OMTs which lack a choke or have PIM above a threshold level, and require non-concurrent Tx/Rx signal propagation (e.g. timewise separated) to render PIM concerns for parasitic mixing of concurrent Tx/Rx signals irrelevant. Concurrent Tx/Rx signal propagation typically requires use of specialty structures or arms, such as recombination networks or turnstile structures, which are costly to manufacture and difficult to achieve precision high enough to provide for wide bandwidth and low PIM. In order to achieve broad bandwidth, recombination arms must be either manually tuned, electroformed or both. Also, the asymmetry of having a 'side arm' portion of OMT assembly 101, such as having port 112 perpendicular to the longitudinal axis of the waveguide, can introduce undesired propagation modes. In the past, recombination networks or other structures were employed to suppress/reduce these undesired modes. Advantageously, the enhanced geometry and manufacturability of the waveguide cavities and structural configuration of OMT assembly 101 achieves mode suppression of undesired modes in a less complex mechanical arrangement than with recombination networks. Specifically, the geometry and structure of OMT assembly 101 includes cross-sectional transitions that reduce cross-sectional area of the corresponding cavity/waveguide and suppress higher order modes. The dimensions of the waveguide cross-section are selected to be small as possible to suppress undesired modes but not inhibit a dominant mode by having too small of a dimension.

Figure 3:
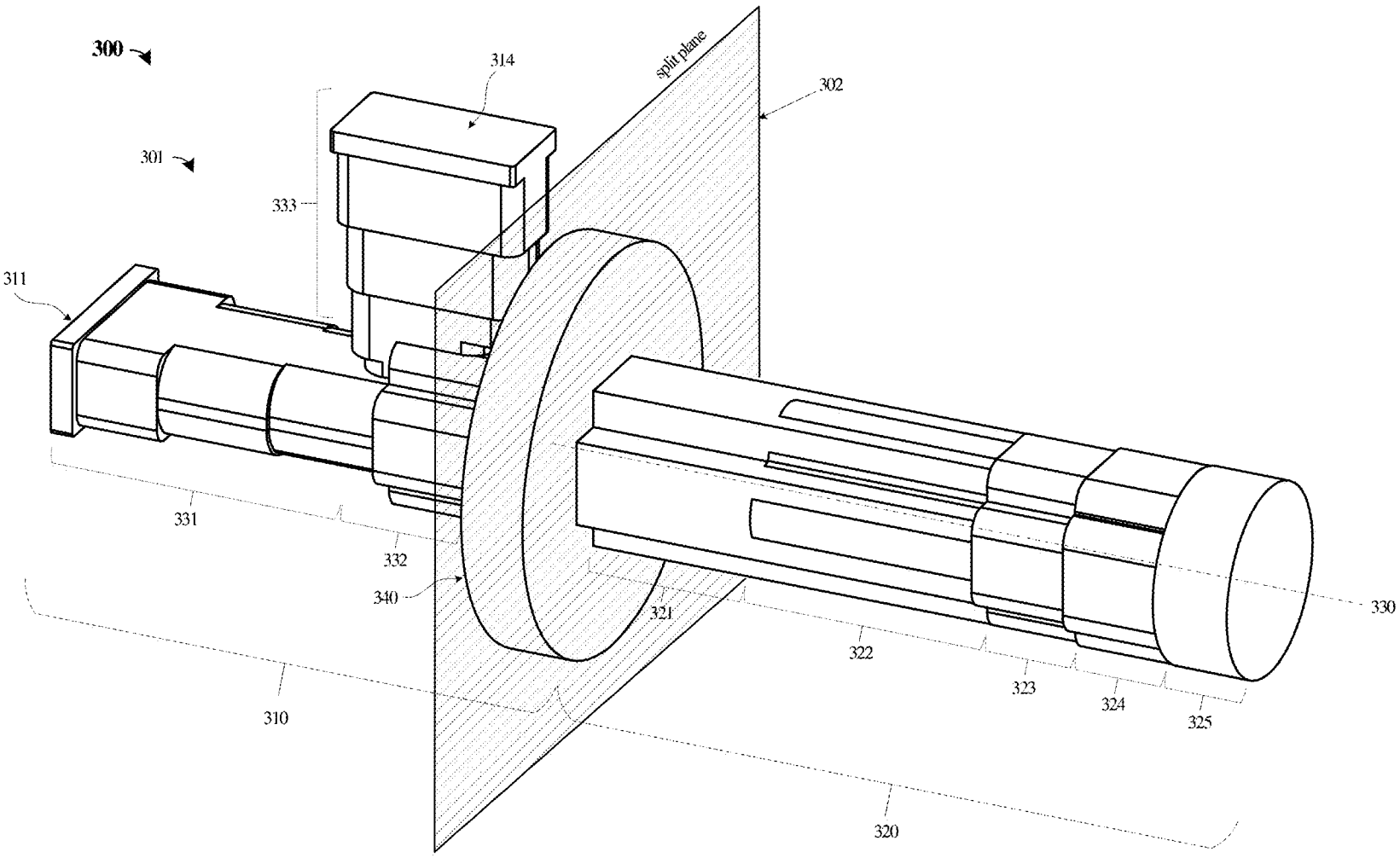
FIG. 3 illustrates an air cavity view of an orthomode transducer in an implementation.
Figure 4:
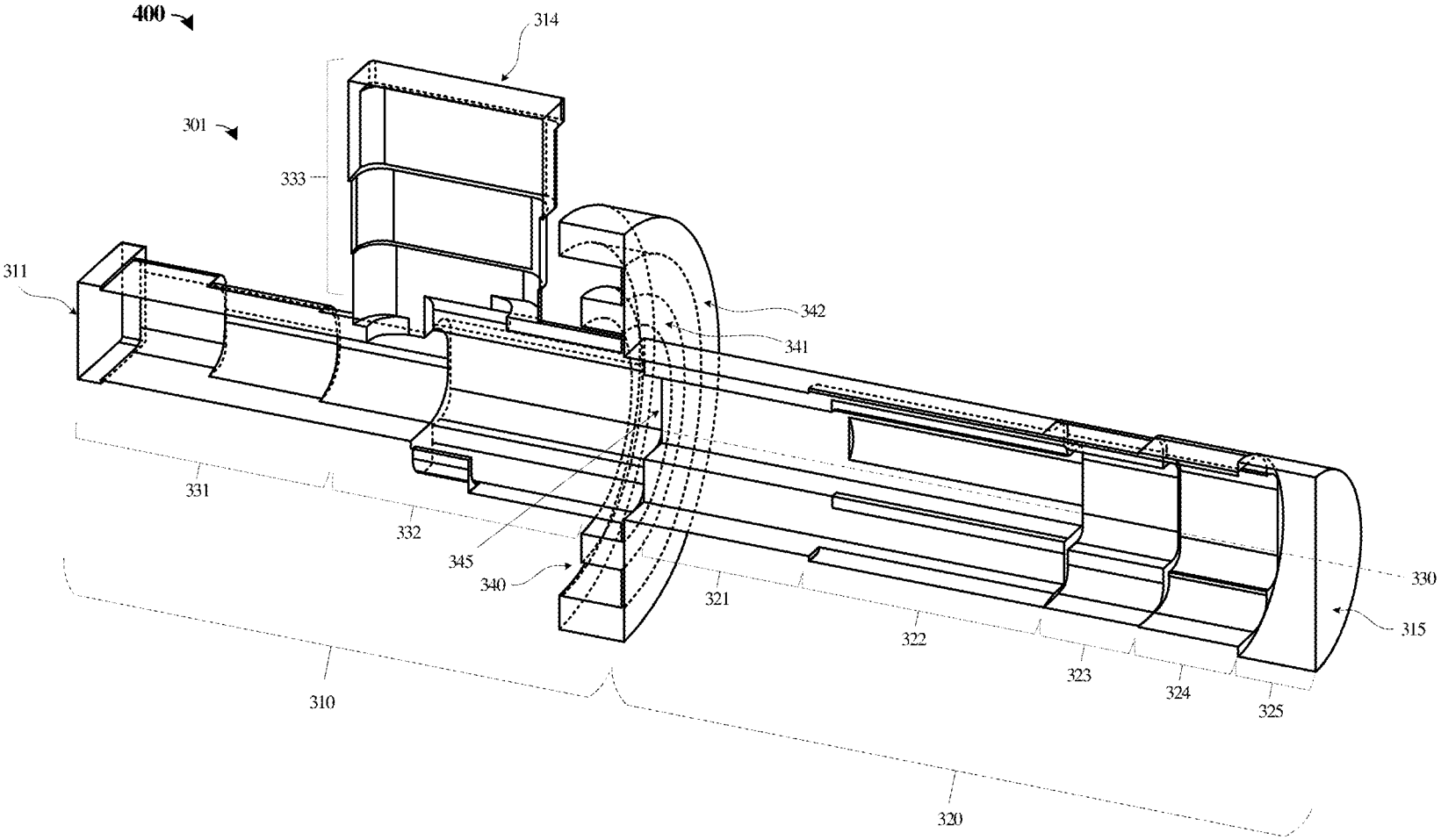
FIG. 4 illustrates an air cavity view of an orthomode transducer in an implementation.
Figure 5:
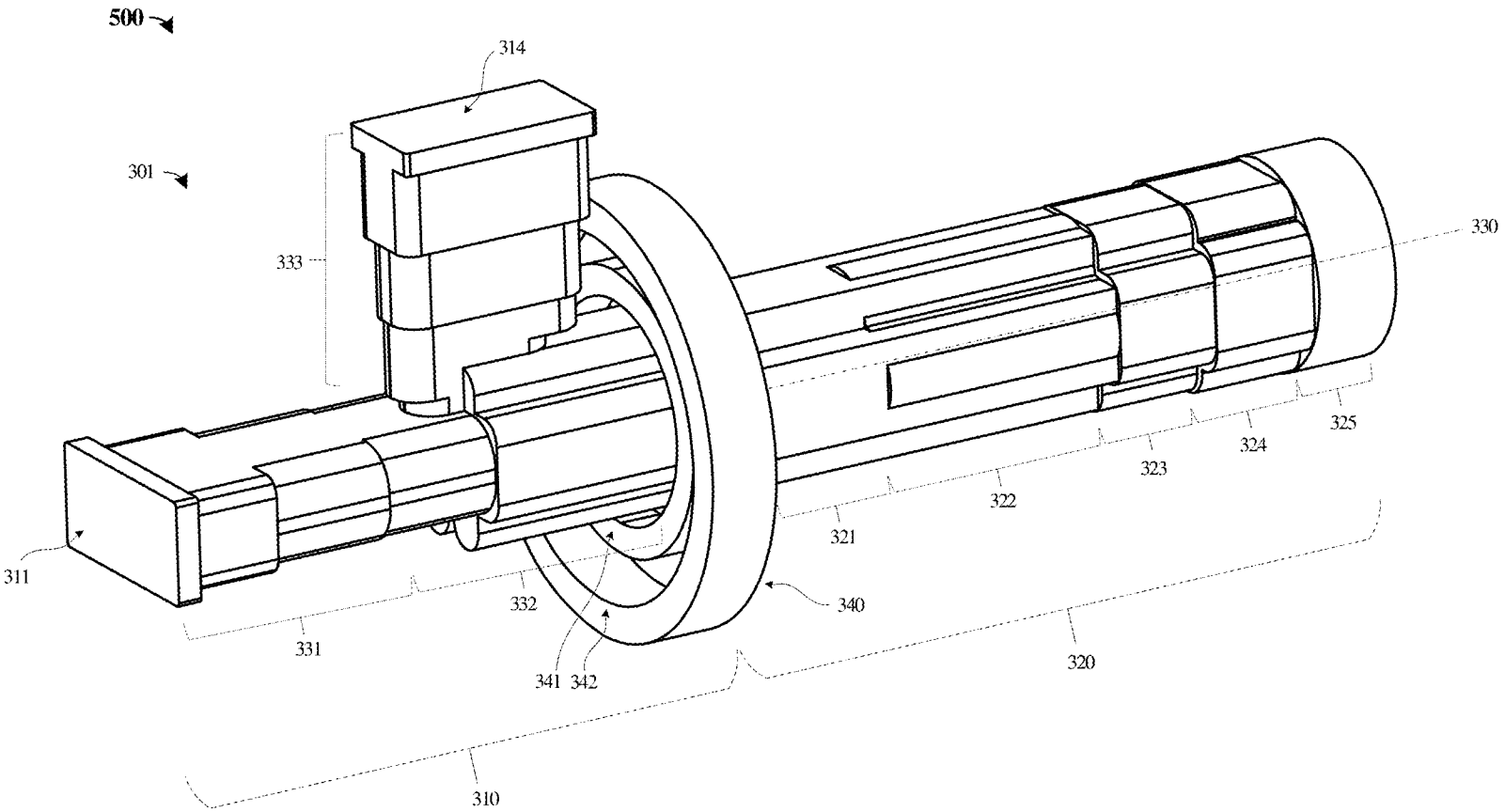
FIG. 5 illustrates an air cavity view of an orthomode transducer in an implementation.

To further illustrate the internal structures and geometries of the cavities that form waveguides, junctions, and ports/apertures of OMT assembly 101, FIGS. 3-6 are included. FIGS. 3-6 illustrate air cavity views or internal spaces, and not the material/walls seen in FIGS. 1 and 2. Walls or enveloping materials can be manufactured to achieve the air cavities seen in FIGS. 3-6. Also, although features of FIGS. 3-6 might be employed for elements of FIGS. 1 and 2, it should be understood that the corresponding air cavities can be achievable using different external material/structural configurations than those shown in FIGS. 1 and 2. FIG. 3 shows isometric view 300 of air cavity 301. FIG. 4 shows isometric cross-sectional view of air cavity 301. FIG. 5 shows a different orientation than view 300 and view 400 in isometric view 500 of air cavity 301.

Air cavity 301 includes two main portions, first portion 310 and second portion 320 which are joined at split plane 302. First portion 310 comprises junction waveguide 332 which combines/separates signals associated with horizontal arm 333 and vertical arm 331. Horizontal arm 333 includes horizontal polarization aperture 314. Vertical arm 331 includes vertical polarization aperture 311. Junction waveguide 332 forms a waveguide cavity along longitudinal axis 330 and terminates at split plane 302. Choke element 340 is formed around a portion of junction waveguide 332. Choke element 340 includes two concentric cavities 341-342 which surround junction waveguide 332 and also terminates at split plane 302. Thus, first portion 310 comprises a cruciform waveguide junction with an integrated double choke. Formation of first portion 310 can be achieved using direct machining, such as milling. In one example, first portion 310 is manufactured by forming junction element comprising a vertically polarized signal arm/aperture along a longitudinal axis and a horizontally polarized signal arm/aperture along an axis perpendicular to the longitudinal axis. A waveguide element of first portion 310 can be formed having a cruciform cavity, coupled to the vertically polarized signal arm/aperture and the horizontally polarized signal arm/aperture, and extending along the longitudinal axis to split plane 302. Also, the manufacturing operations include forming choke element 340 about at least a portion of the waveguide element and extending to the split plane 302.

A joint or interface between the two air cavities associated with first portion 310 and second portion 320 is established at split plane 302. When joined, first portion 310 and second portion 320 form a combined longitudinal waveguide cavity. Contact between the two air cavities can be selected to occur in a zero-current region of the combined longitudinal waveguide cavity to mitigate PIM effects. A discontinuity or step 345 in impedance is also established at split plane 302 but a change in diameter of the combined longitudinal waveguide cavity. While the diameter of the waveguide associated with first portion 310 is a first diameter, the diameter of the waveguide associated with second portion is a second, smaller, diameter. Thus, FIG. 3 shows a waveguide configuration that avoids mating between metals, both similar and dissimilar, in peak current regions of the waveguide. Also, by utilizing choke element 340 at the interface, the configuration ensures that any metal-to-metal contact happens in the near-zero current region of the waveguide.

Second portion 320 is comprised entirely of a waveguide which is divided into several segments 321-325 leading to feed aperture 315. Second portion 320 is formed within a snout element extending (at step 345) from split plane 302 to feed aperture 315. First segment 321 comprises a cruciform cross-sectional cavity that extends along axis 330 to second segment 322. Second segment 332 comprises a cross-section that transitions from the cruciform cross-section of first segment 331 to a cruciform quatrefoil cross-sectional cavity of third segment 333. Third segment 333 transitions from a first cruciform quatrefoil formed with circles/cylinders of a first diameter to a second quatrefoil formed with circles/cylinders of a second, larger, diameter. Fourth segment 334 transitions from the second quatrefoil cross-section to a circular cross-section associated with fifth segment 325. Fifth segment 325 matches a cross-section of feed aperture 315. Thus, the combined waveguide cavity of section portion 320, or snout cavity, transitions from a cruciform cavity to a cruciform-quatrefoil cavity and from the cruciform-quatrefoil cavity to a circular cavity comprising the feed aperture. Other cross-sections might be employed for feed aperture 315, and fifth segment 325 can be employed to transition from the cruciform-quatrefoil cavity to the cross-section of feed aperture 315.

Although the diameters and lengths can vary among the waveguides of first portion 310 and second portion 320, these parameters will typically be selected in accordance with the desired frequency range. For example, the longitudinal waveguide cavity comprising segments 321-325 of second portion 320 each comprise diameters selected to pass dominant modes of signals for a selected frequency range and suppress higher odd-order modes of the signals (i.e. the 3rd, 4th, 5th and 6th modes, among others).

Figure 6:
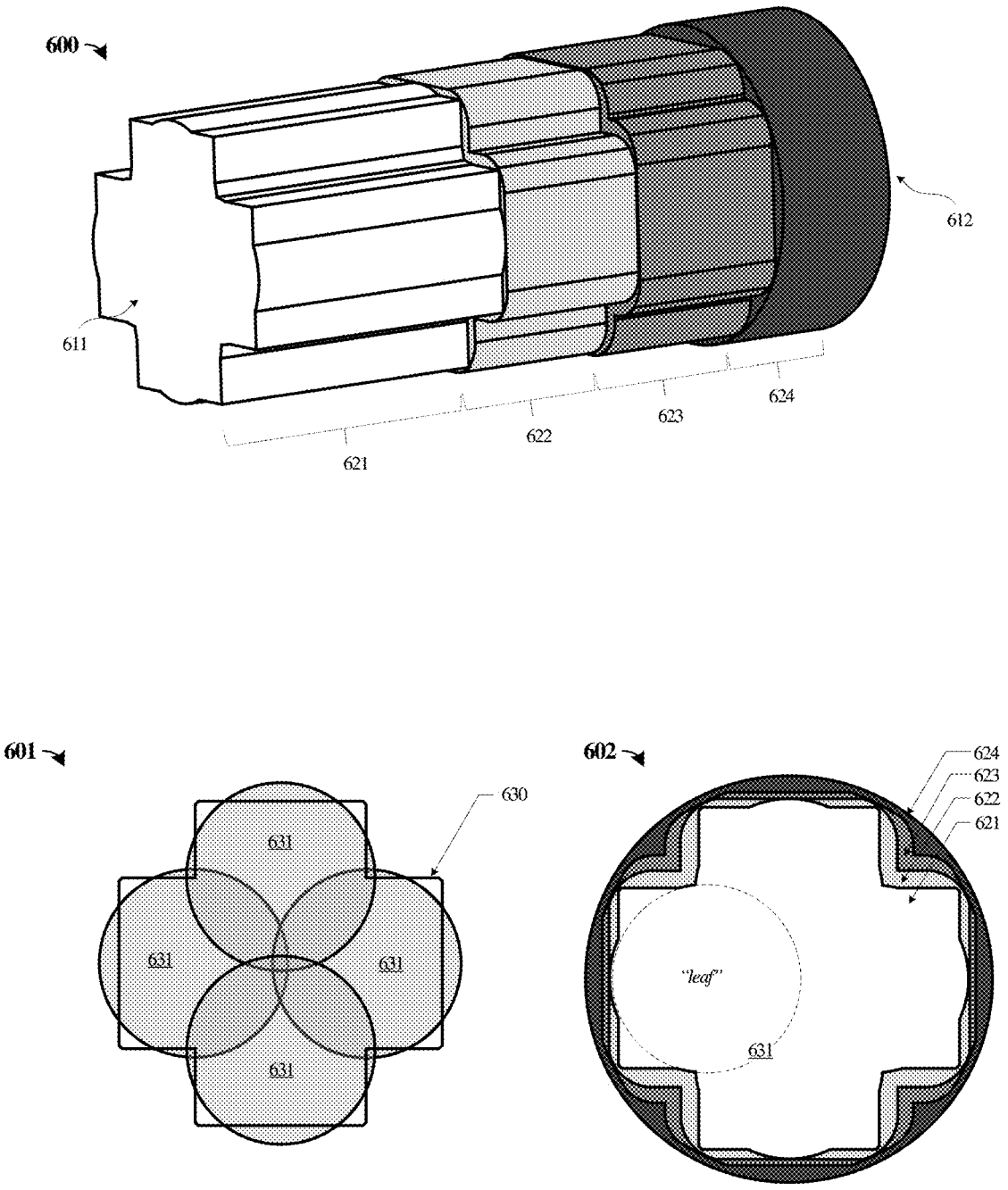
FIG. 6 illustrates example manufacturing techniques for producing an orthomode transducer in an implementation.

FIG. 6 illustrates various manufacturing methods or processes which can be employed to form the waveguides and air cavities of the snout portion of an OMT assembly. FIG. 6 illustrates air cavity 600 for a snout portion having a configuration with potentially a higher level of manufacturability than other configurations. Air cavity 600 might be formed in a workpiece using direct machining, end milling, wire electrical discharge machining (EDM) operations, or other processes. However, the configuration shown in FIG. 6 avoids the need for electroforming and plunge EDM processes which can be more expensive and time consuming. When end-milling of a workpiece is employed, a single wire EDM operation might still be needed which pulls all the way from aperture 611 through port 612 without intersection.

Air cavity 600 comprises transitions among cross-sections from cruciform to quatrefoil to circular over the longitudinal length of air cavity 600. Although four transitional segments 621-624 are shown in FIG. 6, it should be understood that a different quantity of segments might instead be employed to achieve similar shapes and cross-sectional transformations as shown. Segments 621-624 each have different geometric properties to make the transition from cruciform to cruciform quatrefoil to quatrefoil to circular. Aperture 611 comprises a cruciform (cross) cross-section which is reflected in first segment 621. First segment 621 comprises a similar shape and cross-section throughout the length of segment 621, and a cross-sectional transition occurs at the boundary with segment 622. Segment 622 includes a first quatrefoil cross-section throughout the segment, and segment 623 includes a second quatrefoil cross-section through the segment. Finally, a circular cross-section for aperture 612 is established for segment 624.

To manufacture air cavity 600, operational views 601-602 are shown. First, a workpiece, such as a suitable length of metal stock, is machined to form a cruciform cross-section. The depth of the machining might occur only to the depth shown for segment 621, or may instead penetrate the entire longitudinal length of the workpiece. When the machining operation penetrates the entire longitudinal length, a wire EDM operation might be employed. This step is reflected in shape 630 in view 601. After this cruciform cross-section cavity has been established in the workpiece, then four (4) merged, overlapping, or superimposed cylindrical cuts (end mill operations 631) are performed to form the "leaves" of the quatrefoil shape. These circular end mill operations can occur sequentially. End mill operations 631 might occur to a particular depth corresponding to that of segments 622, 623, and 624, or may instead penetrate the entire longitudinal length of the workpiece (even through shape 630). From here, view 602 shows several end milling operations which produce an increasingly larger diameter and transition from cruciform to quatrefoil among segments 622 and 623. Finally, a circular end milling operation forms segment 624.

Advantageously, the operations shown in FIG. 6 establish air cavity 600 without requiring any undercuts. The "leaves" are representative of a large endmill diameter which can reach deep into the snout. This enables direct machining, avoids any electroforming or sinker EDM operations and reduces length of the snout. When the leaves are united with the cruciform, a waveguide is formed which not only suppresses higher order modes but also serves as an impedance transform up to the remainder of the direct machined steps.

Figure 7:
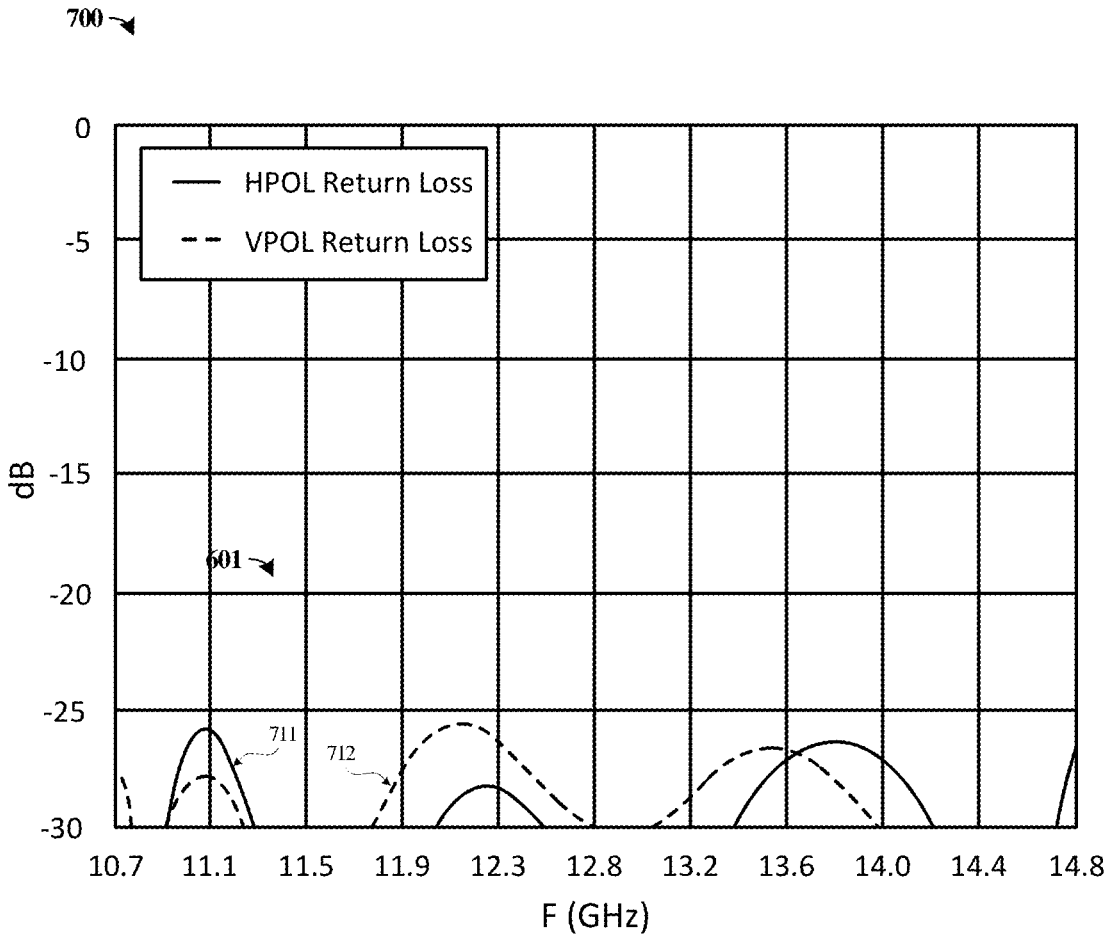
FIG. 7 illustrates performance characteristics of an orthomode transducer in an implementation.

FIG. 7 is included to show example performance characteristics for an OMT assembly using the quatrefoil-cruciform or clover-cruciform shape discussed herein. Graph 700 includes two plots 711-712. Plot 711 shows horizontal polarization (HPOL) return loss, while plot 712 shows vertical polarization (VPOL) return loss. A vertical graph axis corresponds to less in decibels (dB), while a horizontal graph axis corresponds to frequency in GHz. As seen in graph 700, a greater than 25 dB return loss is exhibited for the full Ku band using the enhanced OMT assemblies discussed herein. Specifically, the enhanced OMT assemblies are comprised of two parts, a first part and a second part, which when joined form the device as well as a low PIM double choke flange and critical impedance step. This critical impedance steps enables matching of the junction in excess of 25 dB return loss on both V and H Polarizations over a broad bandwidth (full or partial Ku Band).

The functional block diagrams, operational scenarios and sequences, and flow diagrams provided in the Figures are representative of exemplary systems, environments, and methodologies for performing novel aspects of the disclosure. While, for purposes of simplicity of explanation, methods included herein may be in the form of a functional diagram, operational scenario or sequence, or flow diagram, and may be described as a series of acts, it is to be understood and appreciated that the methods are not limited by the order of acts, as some acts may, in accordance therewith, occur in a different order and/or concurrently with other acts from that shown and described herein. For example, those skilled in the art will understand and appreciate that a method could alternatively be represented as a series of interrelated states or events, such as in a state diagram. Moreover, not all acts illustrated in a methodology may be required for a novel implementation.

The various materials and manufacturing processes discussed herein are employed according to the descriptions above. However, it should be understood that the disclosures and enhancements herein are not limited to these materials and manufacturing processes, and can be applicable across a range of suitable materials and manufacturing processes. Thus, the descriptions and figures included herein depict specific implementations to teach those skilled in the art how to make and use the best options. For the purpose of teaching inventive principles, some conventional aspects have been simplified or omitted. Those skilled in the art will appreciate variations from these implementations that fall within the scope of this disclosure. Those skilled in the art will also appreciate that the features described above can be combined in various ways to form multiple implementations.

What is claimed is:

1. An orthomode transducer, comprising:

a junction element comprising a vertically polarized signal aperture along a longitudinal axis and a horizontally polarized signal aperture along an axis perpendicular to the longitudinal axis;

a waveguide element having a cruciform cavity coupled to the vertically polarized signal aperture and the horizontally polarized signal aperture and extending along the longitudinal axis to a split plane;

a choke element formed about at least a portion of the waveguide element and extending to the split plane;

a snout element extending the cruciform cavity from the split plane along the longitudinal axis and comprising a snout cavity that transitions from the cruciform cavity to a cruciform-quatrefoil cavity and from the cruciform-quatrefoil cavity to a feed aperture.

2. The orthomode transducer of claim 1, wherein the snout cavity transitions from the cruciform-quatrefoil cavity to a circular cavity comprising the feed aperture.

3. The orthomode transducer of claim 1, comprising:

a joint element that mates the waveguide element to the snout element at the split plane with a selected gapping over at least an inner portion of a radius of the split plane.

4. The orthomode transducer of claim 3, wherein the choke element is open to the cruciform cavity via the selected gapping on a side proximate to the snout element and closed by an outer portion of the radius of the split plane by the joint element on the side proximate to the snout element.

5. The orthomode transducer of claim 1, wherein the choke element comprises two concentric cavities forming a double choke.

6. The orthomode transducer of claim 1, wherein the split plane establishes an impedance step within the cruciform cavity.

7. The orthomode transducer of claim 1, wherein a longitudinal waveguide cavity comprising the cruciform cavity, the cruciform-quatrefoil cavity, and the feed aperture comprises diameters selected to pass dominant modes of signals for a selected frequency range and suppress higher order modes of the signals.

8. The orthomode transducer of claim 7, wherein the selected frequency range comprises at least a portion of the Ku microwave frequency band from approximately 10-15 gigahertz.

9. The orthomode transducer of claim 1, wherein a longitudinal waveguide cavity comprising the cruciform cavity and the cruciform-quatrefoil cavity is formed by machining the cruciform cavity from a material forming the snout element and end milling four merged cylindrical cuts to form the cruciform-quatrefoil cavity from the material.

10. An assembly, comprising:

a first workpiece comprising:

a junction element comprising a vertically polarized signal aperture along a longitudinal axis and a horizontally polarized signal aperture along an axis perpendicular to the longitudinal axis;

a waveguide element having a cruciform cavity coupled to the vertically polarized signal aperture and the horizontally polarized signal aperture and extending along the longitudinal axis to a split plane;

a choke element formed about at least a portion of the waveguide element and extending to the split plane; and a second workpiece comprising:

a snout element extending the cruciform cavity from the split plane along the longitudinal axis and comprising a snout cavity that transitions from the cruciform cavity to a cruciform-quatrefoil cavity and from the cruciform-quatrefoil cavity to a circular cavity comprising a feed aperture.

11. The assembly of claim 10, comprising:

the second workpiece comprising:

a joint element that mates the waveguide element to the snout element at the split plane with a selected gapping over at least an inner portion of a radius of the split plane, wherein the choke element is open to the cruciform cavity via the selected gapping on a side proximate to the snout element and closed by an outer portion of the radius of the split plane by the joint element on the side proximate to the snout element.

12. The assembly of claim 10, wherein a combined waveguide cavity comprising the cruciform cavity, the cruciform-quatrefoil cavity, and the circular cavity comprises diameters selected to pass dominant modes of signals for a selected frequency range and suppress higher order modes of the signals, wherein the selected frequency range comprises at least a portion of the Ku microwave frequency band from approximately 10-15 gigahertz.

13. A method, comprising:

forming a junction element comprising a first rectangular aperture along a longitudinal axis and a second rectangular aperture along an axis perpendicular to the longitudinal axis;

forming a waveguide element having a cruciform cavity coupled to the first rectangular aperture and the second rectangular aperture and extending along the longitudinal axis to a split plane;

forming a choke element formed about at least a portion of the waveguide element and extending to the split plane;

forming a snout element extending the cruciform cavity from the split plane along the longitudinal axis and comprising a snout cavity that transitions from the cruciform cavity to a cruciform-quatrefoil cavity and from the cruciform-quatrefoil cavity to a circular aperture.

14. The method of claim 13, wherein the snout cavity transitions from the cruciform-quatrefoil cavity to a circular cavity comprising the circular aperture.

15. The method of claim 13, further comprising:

forming a joint element that mates the waveguide element to the snout element at the split plane with a selected gapping over at least an inner portion of a radius of the split plane.

16. The method of claim 15, wherein the choke element is open to the cruciform cavity via the selected gapping on a side proximate to the snout element and closed by an outer portion of the radius of the split plane by the joint element on the side proximate to the snout element.

17. The method of claim 13, wherein the choke element comprises two concentric cavities forming a double choke.

18. The method of claim 13, wherein a longitudinal waveguide cavity comprising the cruciform cavity, the cruciform-quatrefoil cavity, and the circular aperture comprises diameters selected to pass dominant modes of signals for a selected frequency range and suppress higher order modes of the signals.

19. The method of claim 18, wherein the selected frequency range comprises at least a portion of the Ku microwave frequency band from approximately 10-15 gigahertz.

20. The method of claim 13, comprising:

forming a longitudinal waveguide cavity comprising the cruciform cavity and the cruciform-quatrefoil cavity is by at least machining the cruciform cavity from a material forming the snout element and end milling four merged cylindrical cuts to form the cruciform-quatrefoil cavity from the material.

* * * * *